US006668720B2

(12) United States Patent
Jentzsch

(10) Patent No.: US 6,668,720 B2
(45) Date of Patent: Dec. 30, 2003

(54) APPARATUS FOR IMAGE FORMATION ON CYLINDRICAL SURFACES IN PRINTING MACHINES

(75) Inventor: Arndt Jentzsch, Coswig (DE)

(73) Assignee: Koenig & Bauer AG, Würzburg (DE)

( * ) Notice: Subject to any disclaimer, the term of this patent is extended or adjusted under 35 U.S.C. 154(b) by 45 days.

(21) Appl. No.: 09/948,009

(22) Filed: Sep. 6, 2001

(65) Prior Publication Data

US 2002/0053295 A1 May 9, 2002

(30) Foreign Application Priority Data

Sep. 15, 2000 (DE) ..... 100 45 682

(51) Int. Cl.[7] ..... B41F 5/00

(52) U.S. Cl. ..... 101/217; 101/463.1; 101/464; 101/465; 101/466; 101/467; 101/401.1

(58) Field of Search ..... 101/463.1, 464–467, 101/401.1, 217

(56) References Cited

U.S. PATENT DOCUMENTS 4,395,946 A * 8/1983 Price ..... 101/152
5,129,321 A * 7/1992 Fadner ..... 101/467
5,713,287 A * 2/1998 Gelbart ..... 101/467
5,832,821 A * 11/1998 Petersen et al. ..... 101/216
5,947,020 A * 9/1999 Bornhorst et al. ..... 358/3.3
5,996,499 A * 12/1999 Gelbart et al. ..... 101/467
6,070,528 A * 6/2000 Fleischmann et al. ..... 101/170
6,127,034 A * 10/2000 Chorley ..... 428/375
6,152,037 A * 11/2000 Ishii et al. ..... 101/466
6,180,325 B1 * 1/2001 Gelbart ..... 430/397
6,283,019 B1 * 9/2001 Dolves ..... 358/3.29
6,302,020 B1 * 10/2001 Becker et al. ..... 101/170
6,357,976 B1 * 3/2002 Weidlich ..... 409/131

* cited by examiner

*Primary Examiner*—Andrew H. Hirshfeld
*Assistant Examiner*—Andrea Evans
(74) *Attorney, Agent, or Firm*—Goodwin Procter L.L.P.

(57) ABSTRACT

The invention relates to an apparatus for image formation on cylindrical surfaces of printing machines. The object of the invention is to provide a compact image formation unit with a broad application rage regarding its usage, the sequence in time and variation in time of the process steps. The invention accomplishes this by processing units mounted on slides movable separately on a common cross bar. Each slide carries at least one processing unit. The cross bar is located in a gusset area between a plate cylinder and a blanket cylinder.

18 Claims, 4 Drawing Sheets

APPARATUS FOR IMAGE FORMATION ON CYLINDRICAL SURFACES IN PRINTING MACHINES

FIELD OF THE INVENTION

The present invention relates to an apparatus for image formation on cylindrical surfaces in printing machines comprising multiple processing units arranged side by side and allocated to the plate cylinder of the printing machine. The processing units can be moved axially to the plate cylinder.

BACKGROUND OF THE INVENTION

A printing machine with a printing unit having a gapless image cylinder,.which is coated with a dryable polymer by a direct image formation process, is known through DE 19612927 A1. The surface characteristic of this polymer layer on the image cylinder is changed completely or partially by a selective laser beam in order to change its affinity to printing ink. The image cylinder is used instead of a plate cylinder in a conventional offset press either in wet offset or dry offset printing. The image cylinder is cleaned from the image carrying layer after finishing printing. The layer must not be removed completely. The radiation source, the coating unit and the drying unit are arranged side by side on a spindle drive and moved by the spindle drive over the width of the cylindrical surface to be imaged. The cleaning unit is mounted separately.

The disadvantage of this solution is the lack of processing space caused by the number and fixed allocation of the processing units. The versatility of this apparatus is insufficient for many applications.

SUMMARY DESCRIPTION OF THE INVENTION

The object of the invention is to provide a compact image formation unit with a broad application range regarding its usage, the sequence in time and variation in time of the process steps.

The present invention accomplishes this by processing units mounted on slides movable separately on a common cross bar. Each slide carries at least one processing unit. The cross bar is located in a gusset area between the plate cylinder and a blanket cylinder.

An advantage of the present invention is the variability of using the process steps. It is also possible to adjust the processing intensity of the processing units according to the process requirements by the time effecting the surface.

BRIEF DESCRIPTION OF THE DRAWINGS

The present invention is described below in greater detail by exemplary embodiments of the invention and by reference to the drawings, wherein.

DETAILED DESCRIPTION OF THE INVENTION

Figure 1:
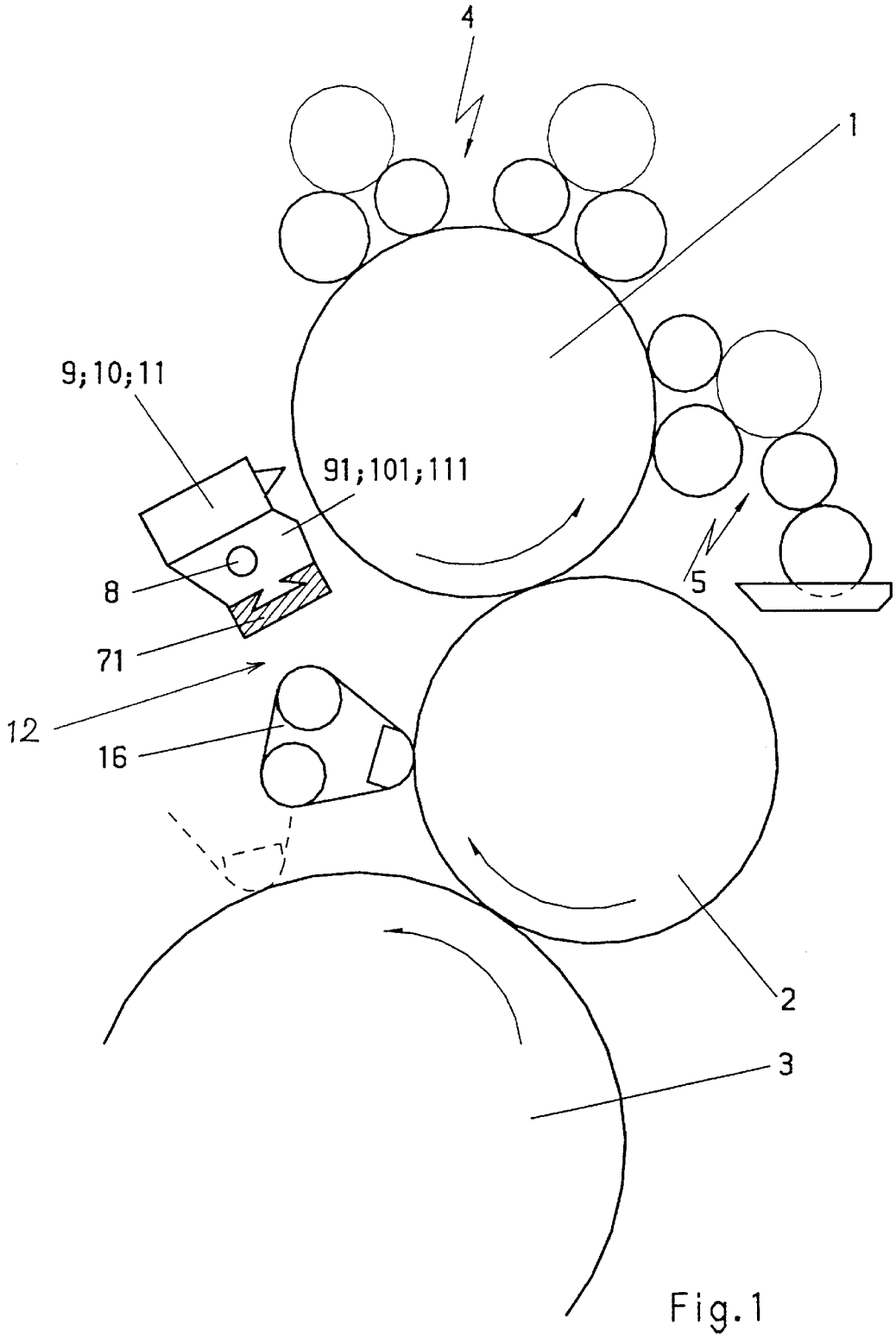
FIG. 1 is a schematic drawing illustrating the roller and cylinder scheme of a printing unit in a printing press with an embodiment of the apparatus of the present invention mounted on a cross bar.

FIG. 1 shows a printing unit of a multi-color sheet fed offset press. The printing unit contains an impression cylinder 3 carrying the sheet and, as the image transferring cylinders, a plate cylinder 1 and a blanket cylinder 2.

An inking unit 4 and a dampening unit 5 are allocated to the plate cylinder 1. The plate cylinder 1 can also carry a printing form, which is not shown in the drawings.

A cross bar 71 is located in a gusset area 12 between the place cylinder 1 and the blanket cylinder 2. The cross bar is located in such a manner that other elements in this area, for instance a cleaning unit 16, are not obstructed in their operational space. The cross bar 71 carries processing units 9, 10 and 11 for image formation on the surface of the plate cylinder 1 with respect to a printing form mounted on the plate cylinder 1.

Figure 2:
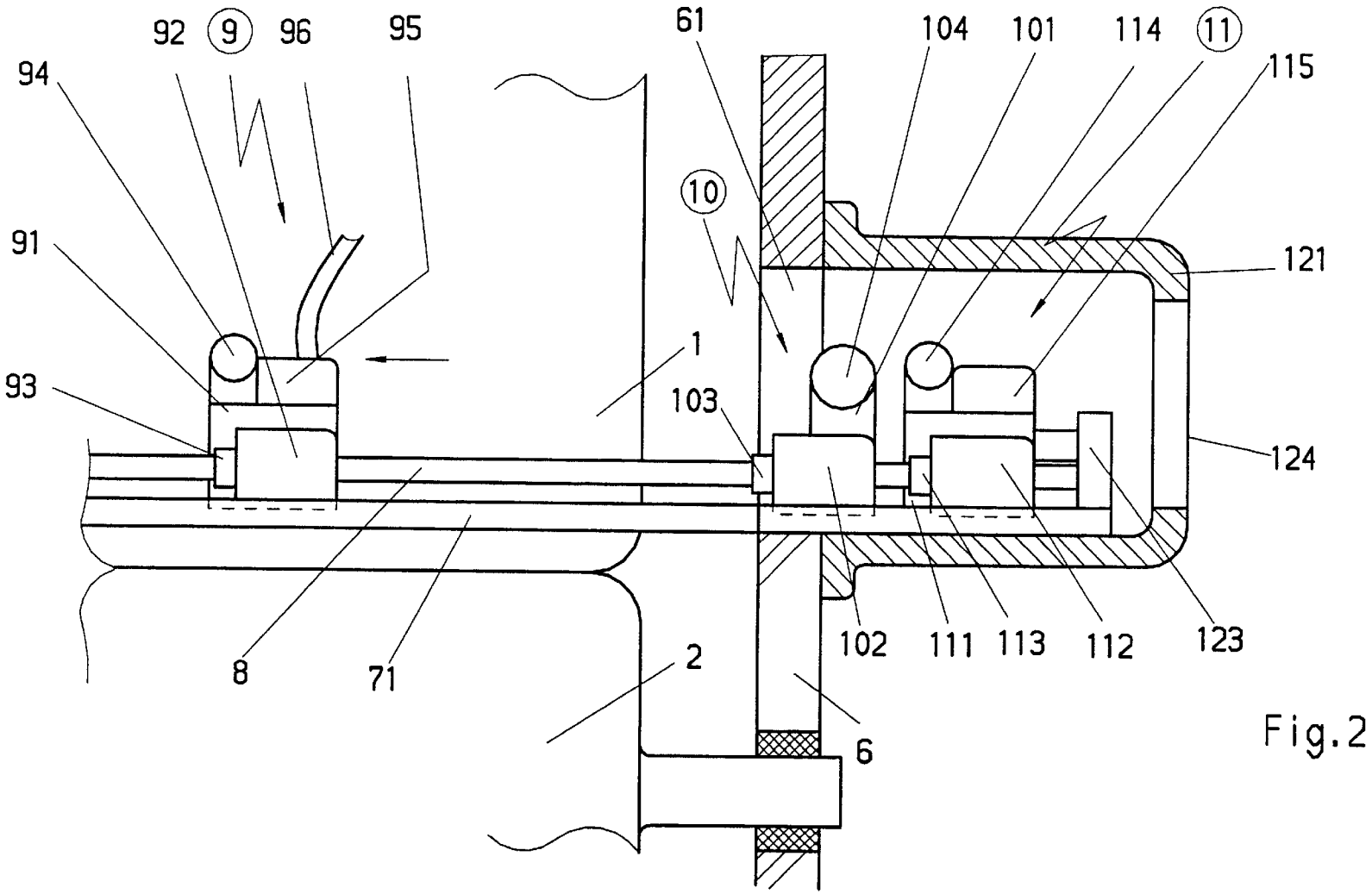
FIG. 2 is a schematic drawing illustrating an embodiment of the apparatus of the present invention mounted on a fixed spindle.

FIG. 2 shows the details of this embodiment. The cross bar 71 is mounted in the side frame 6 of the printing machine. The cross bar 71 stretches parallel to the surface of the plate cylinder 1 over the entire width of the printing press (see also FIG. 3). Parallel to the cross bar 71 is a fixed spindle 8 which is supported in a pillow block 123 and does not rotate.

The cross bar 71 and the fixed spindle 8 extend over the side frame 6. Therefore the side frame 6 has a cut out 61 covered by a housing 121. The housing 121 is accessible by a coverable opening 124.

The first processing unit 9 is mounted on a slide 91. This slide 91 is connected with a first motor 92 driving a first spindle 93. The first spindle 93 is in an operational connection to the fixed spindle 8. The first slide 91 also carries an erasing unit with an erasing head 94 and a suction 95 with a suction hose 96. The erasing head 94 is embodied as a high-energy laser. The erasing head 94 precedes the suction 95 in the moving direction of the first slide 91 (shown by an arrow in FIG. 2).

The first processing unit 9 precedes the second processing unit 10 in the moving direction of the processing units 9, 10 and 11. This unit is also mounted on a slide 101 and has a motor 102 and a spindle 103 of the same configuration. The slide 101 carries a coating unit 104. The coating unit is embodied as an ink jet printing head.

In this embodiment, the next and last processing unit in the processing sequence is the third processing unit 11. It has a motor 112 and a spindle 113, similar to the processing units 9 and 11 described above. A slide 111 carries an image formation unit and a fixation unit 115.

FIGS. 1 and 2 do not show the supply cables and supply hoses to simplify these representations.

The Operation of the Above-described Embodiment is Explained Below:

The three processing unites 9, 10 and 11 are in their parking positions on the side frame 6 respectively at the beginning of the image formation process. They are partially or completely covered by the housing 121.

The first processing unit 9 moves towards the plate cylinder 1 in the direction shown by the arrow in FIG. 2 for image formation. The motor 92 starts its operation and rotates the spindle 93. The slide 91 is moved in the designated direction because the fixed spindle 8 is non-rotating. The plate cylinder 1 rotates with an appropriate speed for this process.

The erasing head 94 is activated if the plate cylinder 1 is reached. The laser of the erasing head 94 erases the image information and thus removes the image layer of the preceding printing job from the plate cylinder 1. The suction 95 takes the loosened particles and removes them from the printing machine. The first processing unit reaches its parking position at the opposite side of the side frame 6 after complete removal of the old image layer. A housing 122 analogous to the housing 121 is provided for this purpose.

The surface of the plate cylinder 1 prepared in this manner is coated by the coating unit 104 in the second processing unit 10 with a layer to be imaged. The movement of this second processing unit 10 is similar to the first processing unit 9. This process starts typically immediately after removal of the old layer for the old image information. The second processing unit 10 also reaches its parking position on the opposite side after finishing coating.

The third processing unit 11 is started as the last processing step after the applied layer hardens after a required period of time. The third processing unit 11 moves in the described manner over the surface of the plate cylinder 1. The actual image information is applied by the laser of the imaging unit 114 and hardened by the fixation unit 115 during this movement.

The processing units 9, 10 and 11 take their park positions on the opposite side after image formation. The printing process can now start. It is advantageous to move the processing units 9, 10 and 11 back to their original positions before printing. The speed of the movement is a multiple of the processing speed. The processing units 9, 10 and 11 can be moved one after the other or together in concert.

The embodiment described above is only one possible embodiment. It is for instance also possible to insert or to integrate an additional processing unit after the second processing unit 10 to harden the layer if technically required. A unit for cleaning and developing can be also inserted after the third processing unit 11.

Figure 3:
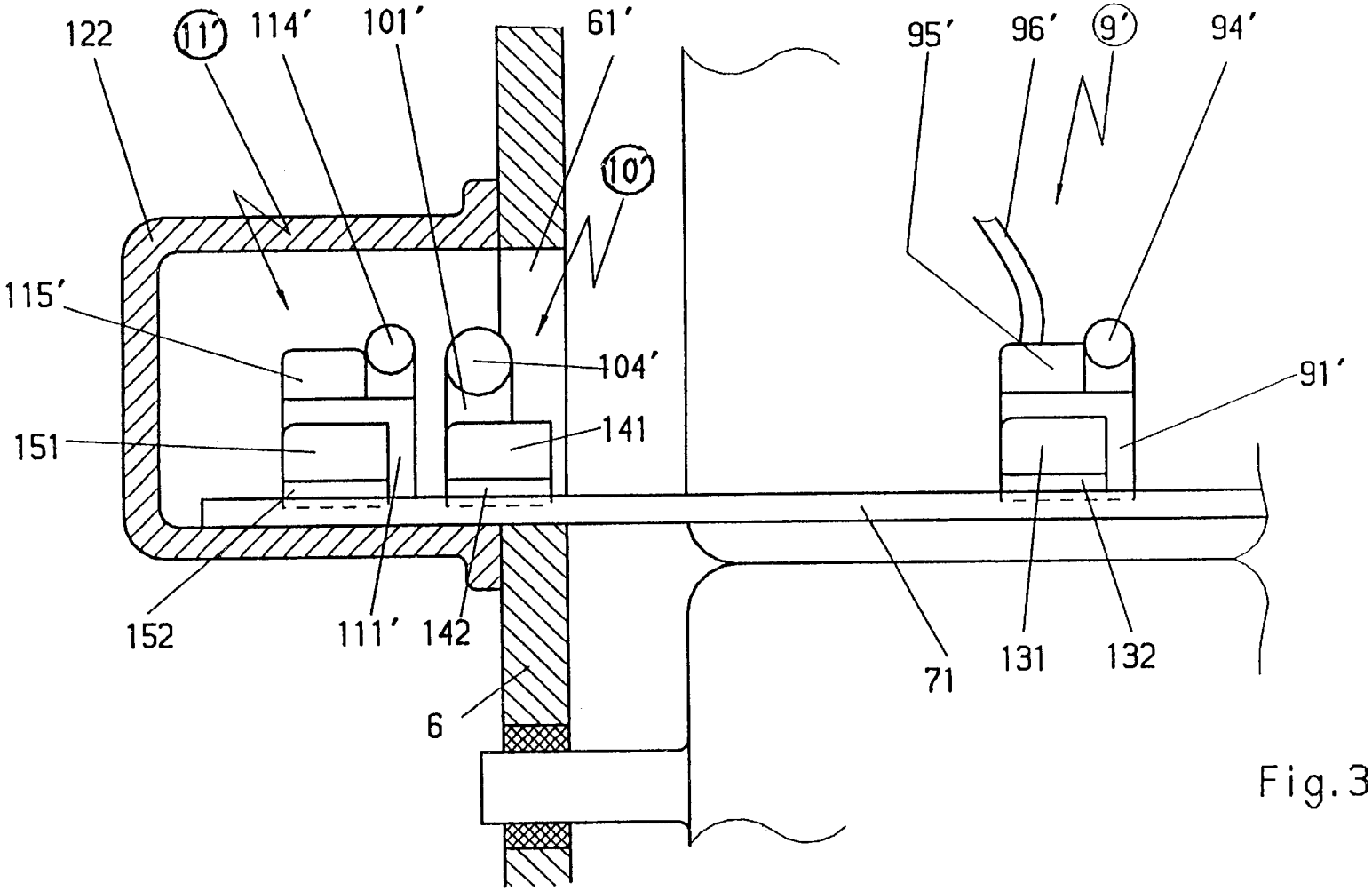
FIG. 3 is a schematic drawing illustrating an embodiment of the apparatus of the present invention mounted on a linear motor drive.

FIG. 3 shows the parking positions of the processing units after image formation. FIG. 3 shows another embodiment of the invention. The processing units 9', 10' and 11' are equipped with linear motors 131, 141 and 151 and are mounted on slides 91', 101' and 111' respectively. They are connected to the cross bar 71 through the drive members 132, 142 and 152. The first processing unit 9' has an erasing head 94' and a suction 95' with a suction hose 96'. The second processing unit 10' has a coating unit 104'. The third processing unit 11' has an imaging unit 114' and a fixation unit 115'. The cross bar 71 extends over a side frame 6. The side frame 6 has a cut out 61' covered by a housing 122. The operation is the same as described above.

Figure 4:
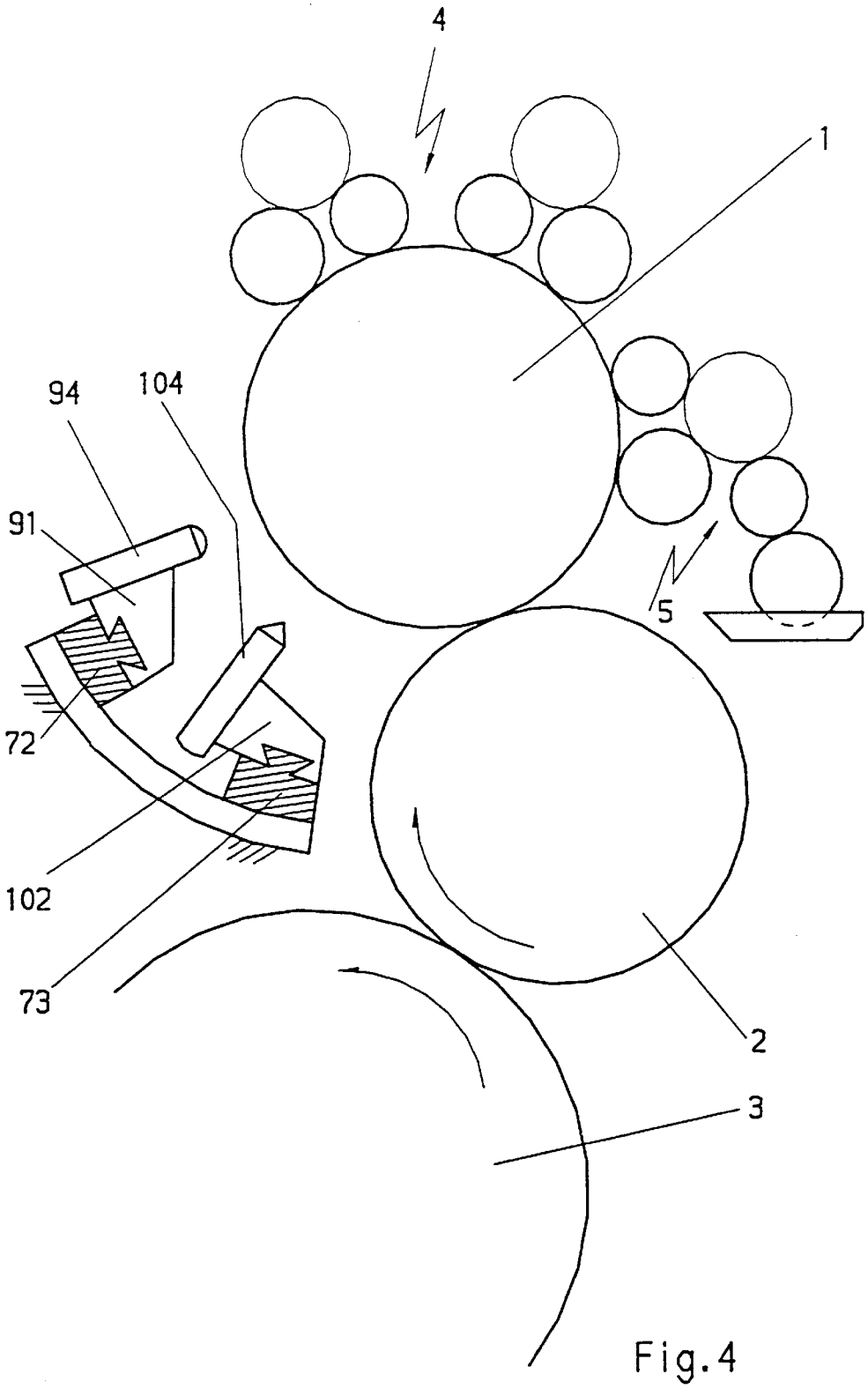
FIG. 4 is a schematic drawing illustrating the roller and cylinder scheme of a printing unit in a printing press with an embodiment of the apparatus of the present invention mounted on two cross bars.

FIG. 4 shows an embodiment with two cross bars 72 and 73. This arrangement has the advantage that in embodiments with more processing units these units can be distributed between the two crossbars 72 and 73. This results in better space distributions and more room in the parking positions adjacent to the side frame 6. Thus the processing units can be driven either by linear motors 131, 141 and 151 or the motors 92, 102 and 112.

I claim:

1. An apparatus for image formation on cylindrical surfaces in printing machines, comprising:

multiple processing units arranged side by side, allocated to a plate cylinder of the printing machine and axially movable to the plate cylinder, wherein the processing units are arranged on slides with at least one processing unit per slide, and the slides are separately moveable on a common cross bar;

wherein a first slide carries an erasing head and a suction.

2. An apparatus for image formation on cylindrical surfaces in printing machines, comprising:

multiple processing units arranged side by side, allocated to a plate cylinder of the printing machine and axially movable to the plate cylinder, wherein the processing units are arranged on slides with at least one processing unit per slide and the slides are separately moveable on cross bars;

wherein a first slide carries an erasing head and a suction.

3. An apparatus for image formation on cylindrical surfaces in printing machines, comprising:

multiple processing units arranged side by side, allocated to a plate cylinder of the printing machine and axially movable to the plate cylinder, wherein the processing units are arranged on slides with at least one processing unit per slide, wherein the slides are separately movable on cross bars and the cross bars are located in a gusset area between the plate cylinder and a blanket cylinder;

wherein a first slide carries an erasing head and a suction.

4. The apparatus according to claim 1, wherein on both sides, parking positions for the processing units during printing are adjacent to a side frame.

5. The apparatus according to claim 4, wherein the parking positions for the processing units on both sides are within a housing covering a cut out of the side frame of the printing machine.

6. The apparatus according to claim 1, wherein the erasing head is a high energy laser.

7. An apparatus for image formation on cylindrical surfaces in printing machines comprising:

multiple processing its arranged side by side, allocated to a plate cylinder of the printing machine and axially movable to the plate cylinder, wherein the processing units are arranged on slides with at least one processing unit per slide, and the slides are separately moveable on a common cross bar;

wherein a second slide carries a coating unit.

8. The apparatus according to claim 7, wherein the coating unit is an ink jet printing head.

9. An apparatus for image formation on cylindrical surfaces in panting machines, comprising:

multiple processing units arranged side by side, allocated to a plate cylinder of the printing machine and axially movable to the plate cylinder, wherein the processing units are arranged on slides with at least one processing unit per slide, and the slides are separately moveable on a common cross bar;

wherein a third slide carries an imaging unit and a fixation unit.

10. The apparatus according to claim 9, wherein the imaging unit is a laser unit.

11. The apparatus according to claim 1, wherein the slides are driven by linear motors connected through drive members with the cross bar.

12. The apparatus according to claim 1, wherein a fixed spindle is connected to the slides through spindle nuts allocated in the slides.

13. The apparatus according to claim 2 wherein the erasing head is a high energy laser.

14. The apparatus according to claim 3 wherein the erasing head is a high energy laser.

15. An apparatus for image formation on cylindrical surfaces in printing machines, comprising:

multiple processing units arranged side by side, allocated to a plate cylinder of the printing machine and axially movable to the plate cylinder, wherein the processing units are arranged on slides with at least one processing unit per slide, wherein the slides are separately movable on cross bars and the cross bars are located in a gusset area between the plate cylinder and a blanket cylinder;

wherein a second slide carries a coating unit.

16. The apparatus according to claim 15, wherein the coating unit is an ink jet printing head.

17. An apparatus for image formation on cylindrical surfaces in printing machines, comprising:

multiple processing units arranged side by side, allocated to a plate cylinder of the printing machine and axially movable to the plate cylinder, wherein the processing units are arranged on slides with at least one processing unit per slide, wherein the slides are separately movable on cross bars and the cross bars are located in a gusset area between the plate cylinder and a blanket cylinder;

wherein a third slide carries an imaging unit and a fixation unit.

18. The apparatus according to claim 17, wherein the imaging unit is a laser unit.

* * * * *

UNITED STATES PATENT AND TRADEMARK OFFICE

CERTIFICATE OF CORRECTION

PATENT NO. : 6,668,720 B2
DATED : December 30, 2003
INVENTOR(S) : Jentzsch

It is certified that error appears in the above-identified patent and that said Letters Patent is hereby corrected as shown below:

Title page,
Item [*] Notice, delete the phrase "by 45 days" and insert -- by 0 days --

Signed and Sealed this

Twelfth Day of October, 2004

JON W. DUDAS
*Director of the United States Patent and Trademark Office*